US005694708A

United States Patent [19]

Theurer et al.

[11] Patent Number: 5,694,708

[45] Date of Patent: Dec. 9, 1997

[54] EXCAVATING AND CONVEYING CHAIN ASSEMBLY WITH TWO-PART SCRAPER FINGERS

[75] Inventors: Josef Theurer, Vienna; Herbert Wörgötter, Gallneukirchen, both of Austria

[73] Assignee: Franz Plasser Bahnbaumaschinen-Industriegesellschaft m.b.H., Vienna, Austria

[21] Appl. No.: 629,854

[22] Filed: Apr. 9, 1996

[30] Foreign Application Priority Data

Apr. 12, 1995 [AT] Austria ..... 636/95

[51] Int. Cl.[6] ..... E02F 5/22

[52] U.S. Cl. ..... 37/104; 37/453; 37/465; 171/16

[58] Field of Search ..... 37/104, 105, 452, 37/453, 454, 455, 456, 460, 465; 171/16; 104/2; 299/82.1, 83.1

[56] References Cited

U.S. PATENT DOCUMENTS

| | | | |
|---|---|---|---|
| T911,018 | 6/1973 | Radigan | 37/454 |
| 2,020,215 | 11/1935 | Ross | 37/454 X |
| 2,168,794 | 8/1939 | Fulke | 37/454 X |
| 3,117,386 | 1/1964 | Ferwerda | 37/454 |
| 3,484,844 | 12/1969 | Petersen | 299/83.1 X |
| 3,623,247 | 11/1971 | Stepe | 37/455 |
| 3,888,637 | 6/1975 | Taguchi et al. | 37/460 X |
| 3,913,979 | 10/1975 | Strauss et al. | 37/460 X |
| 3,968,995 | 7/1976 | Arentzen | 299/83.1 |
| 4,530,403 | 7/1985 | Theurer et al. | 171/16 |
| 4,538,687 | 9/1985 | Theurer et al. | 171/16 |
| 4,753,299 | 6/1988 | Meyers | 37/460 X |
| 4,883,129 | 11/1989 | Lonn et al. | 37/460 X |
| 5,283,965 | 2/1994 | Clendenning | 37/455 |

FOREIGN PATENT DOCUMENTS 1110495 4/1968 United Kingdom .

*Primary Examiner*—Terry Lee Melius
*Assistant Examiner*—Victor Batson
*Attorney, Agent, or Firm*—Henry M. Feiereisen

[57] ABSTRACT

An excavating and conveying chain assembly for transporting ballast of a track includes a plurality of chain links hingedly connected to each other for traveling along a transport path. Connected to each chain link is a scraper blade which has a link-distal end formed with a plurality of projecting scraper fingers. Each scraper finger is of two-part configuration, with a first part being formed by an engagement member secured to the scraper blade and jutting out therefrom in a finger-like manner, and with a second part being formed by a protective cap that is pushed onto the engagement member and detachably secured thereto by a fastener.

18 Claims, 2 Drawing Sheets

EXCAVATING AND CONVEYING CHAIN ASSEMBLY WITH TWO-PART SCRAPER FINGERS

BACKGROUND OF THE INVENTION

The present invention refers to an excavating and conveying chain assembly for transport of ballast of a track, and in particular to an excavating and conveying chain assembly of a type including a plurality of chain links which are hingedly connected to each other for movement along a trough-shaped chain guide, with each chain link being provided with a scraper blade which is formed at the link-distant end with jutting scraper fingers.

Austrian Pat. No. 349 051 B discloses an excavating and conveying chain for use in a track working machine for cleaning a track bed. This conventional chain is conducted in endless fashion along two longitudinally extending chain guides whose lower ends portions are connected via guide rollers by a transversely extending chain guide that runs underneath the track panel to assume an approximate triangular or polygonal configuration. The chain guides are vertically adjustable and laterally swingable by means of a drive mechanism, with each chain guide being of trough-shaped configuration. In the area of the transverse chain guide, scraper blades together with the attached scraper fingers engage the ballast bed and transport ballast gravel towards the bed shoulder and ultimately via the longitudinally extending chain guide to a ballast cleaning screen that is arranged on the machine frame. The scraper fingers are made of wear-resistant material and detachably secured to the scraper blade so as to allow a replacement of the scraper fingers after being subject to progressing wear.

SUMMARY OF THE INVENTION

It is an object of the present invention to provide an improved ballast excavating and conveying chain assembly which allows a more rapid and simpler replacement of worn out scraper fingers.

This object, and others which will become apparent hereinafter, is attained in accordance with the present invention by forming each scraper finger of two-part configuration, with a first part being formed by an engagement member secured to the scraper blade and projecting in a finger like manner, and with a second part being formed by a protective cap that is placed over the engagement member and detachably secured thereto by a fastener.

The two-part configuration of each scraper finger enables the formation of a relatively wide work area for the protective caps in a direction perpendicular to the ballast conveying direction so that the space between neighboring scraper fingers becomes relatively small. This is advantageous because ballast gravel is substantially prevented from dropping between the scraper fingers which would adversely affect the transport capacity of the chain assembly. The scraper fingers can advantageously be formed of narrow configuration in conveying direction to optimize the scarifying effect for rapidly breaking loose ballast material, even encrusted ballast material. The change-over time to replace the scraper fingers is significantly reduced and simplified because the protective caps are simply pushed onto the engagement members, and their number can be reduced in view of their wider configuration. Also, the attachment of the protective cap onto the engagement member realizes between these components a simple snug-fit connection which is capable to absorb without any problem impact forces during loosening of ballast gravel from the track bed.

A further advantage of the present invention is also the complete envelope of the engagement member by the protective cap so that even after extended use, the engagement member is not subject to any wear while still ensuring a simple replacement of the protective cap.

Preferably, the protective cap is secured to the engagement member in a detachable manner by a fastener in form of a heavy-type dowel pin with extends at an angle to the working surface defined by the scraper blade and is received in aligned bores of the engagement member and the protective cap.

In order to essentially eliminate a possibility of ballast gravel from falling or jamming between neighboring scraper fingers, a shovel-like blade element is jutted outwardly from the scraper blade in form of a finger between neighboring scraper fingers.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
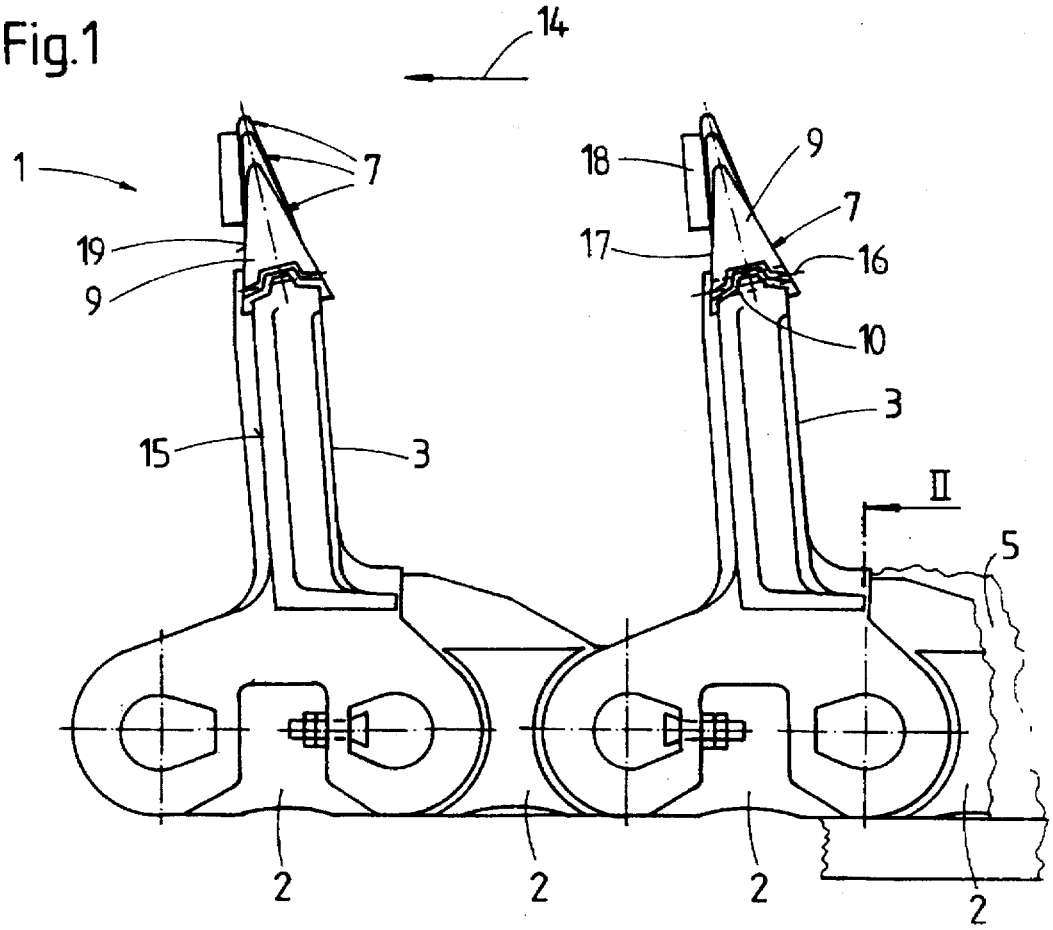
FIG. 1 is a fragmentary plan view of one embodiment of an excavating and conveying chain assembly, illustrating in detail two exemplified scraper blades in accordance with the present invention.

Throughout all the Figures, the same or corresponding elements are generally indicated by the same reference numerals.

Turning now to the drawing, and in particular to FIG. 1, there is shown a fragmentary, plan view of one embodiment of an excavating and conveying chain assembly according to the present invention, generally designated reference numeral 1 and comprised of a plurality of chain links 2. Every other chain link 2 is provided with a shovel-like scraper blade 3 to remove dirty ballast from the ballast bed on which a track may rest. The excavating and conveying chain assembly 1 travels in a transport plane 4 which is formed by a trough-shaped chain guide arrangement 5 and may be comprised of two longitudinally extending chain guides whose lower end portions are connected under a track panel by a transversely extending chain guide. Thus, the chain assembly 1 travels in endless fashion in a triangular path in the trough-shaped chain guide arrangement 5 about guide rollers.

Persons skilled in the art will understand that the excavating and conveying chain assembly 1 is suitably mounted on a machine frame that is supported on undercarriages for mobility on rails of the track in an operating direction. However, the machine frame does not form part of the present invention and has been omitted from the drawing for sake of simplicity. Also, for ease of illustration, a detailed depiction of the chain guide arrangement has been omitted from the drawing.

Each scraper blade 3 is secured in one piece onto the pertaining chain link 2 and carries at its link-distal end 6 a plurality of scraper fingers 7 that jut outwardly beyond the rim of the scraper blade 3. In the nonlimiting example of FIG. 1, each scraper blade 3 carries a total of three scraper fingers 7.

Figure 2:
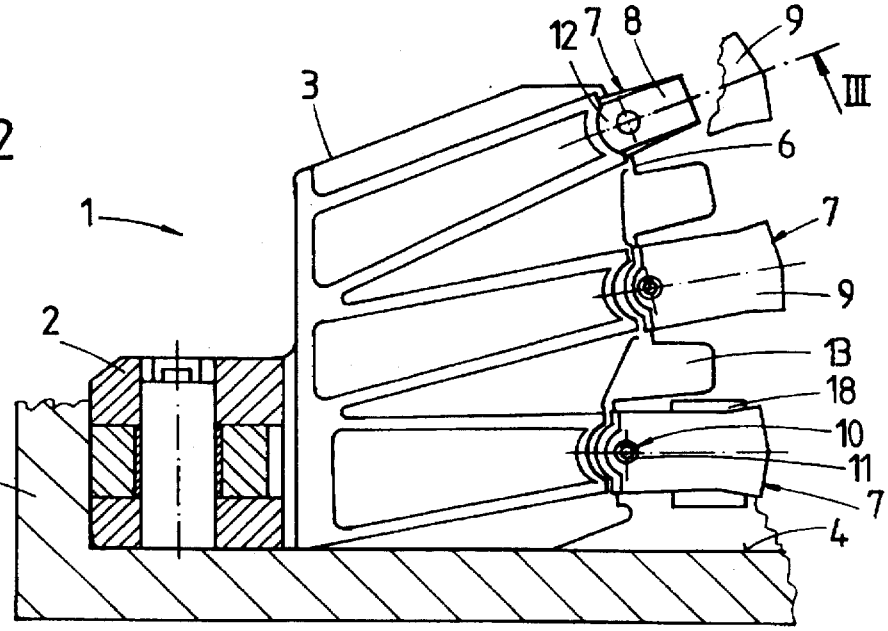
FIG. 2 is a partially sectional view of a scraper blade in conveying direction, taken along the line designated by arrow II in FIG. 1.
Figure 3:
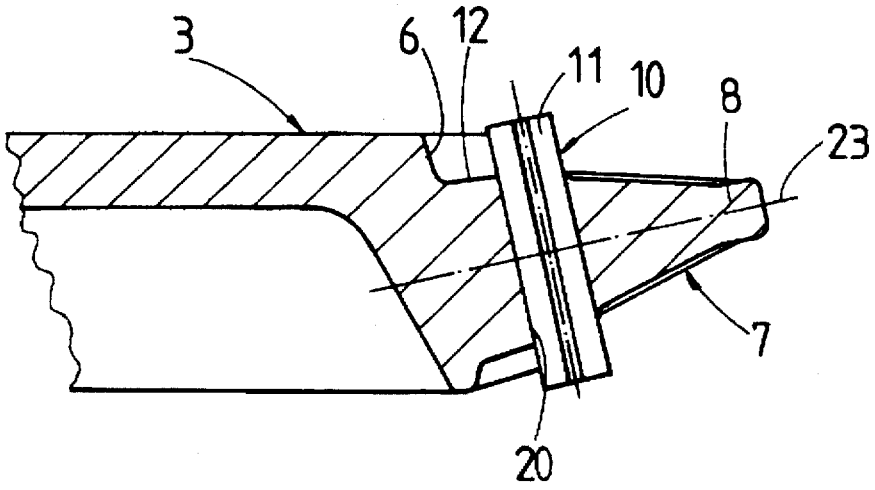
FIG. 3 is a fragmentary, sectional view of a scraper blade, on an enlarged scale, taken along the section line III in FIG. 2, illustrating in detail an engagement member, with the protective cap being omitted.

As shown in particular in FIG. 2, which is a partially sectional view of the scraper blade 3 in conveying direction taken along the line designated by arrow II in FIG. 1, each of the three scraper fingers 7 is of two-part configuration, with a first part being formed by an engagement member 8 that is secured to the link-distal end 6 of the scraper blade 3 and juts outwardly from the rim in a finger-like manner, and with a second part being formed by a protective cap 9 that is pushed onto the engagement member 8. The protective cap 9 fully envelopes the engagement member 8 and is made of wear-resistant material. A fastener, generally designated by reference number 10 detachably secures the protective cap 9 to the engagement member 8. Preferably, the fastener 10 is formed by a heavy-type dowel pin 11 that secures the protective cap 9 to the engagement member 8 at a transition region 12 adjoining the rim-forming link-distal end 6 of the scraper blade 3, as best seen in FIG. 3. As shown in FIG. 1, each scraper blade 3 exhibits in conveying direction as indicated by arrow 14 a leading working plane 15 for transport of ballast, whereby the fastener 10 defines a longitudinal axis 16 which extends at an angle to the working plane 15.

Arranged between neighboring scraper fingers 7 are shovel-like blade elements 13 of a configuration that resembles the engagement member 8. Each blade element 13 projects outwards from the rim 6 of the scraper blade 3 in finger-like fashion and remains uncovered by the protective cap 9. The provision of the blade elements 13 reliably prevents a passage or jamming of ballast gravel between the scraper fingers 7 so that the transport capacity of the excavating and conveying chain assembly I is not adversely affected. The blade elements 13 are shorter than the neighboring scraper fingers 7 and thus are subjected to reduced wear, As shown in particular in FIG. 2, the lowermost scraper finger 7 that is positioned in immediate proximity to the transport plane 4 is provided with a wearing plate 18 which is made of particularly wear-resistant material and secured to the leading working surface 17 in conveying direction of the protective cap 9, e.g. through welding, as shown in detail in FIG. 4. FIG. 1 shows that the working surfaces 17 of the protective caps 9 extend in a common plane 19. Preferably, the working surface 17 and a surface 22 in opposition to the working surface 17 form a trapezoidal cross section, whereby the working surface 17 and the opposite surface 22 extends at an angle to the plane of symmetry 23 of the engagement member 8, with the plane of symmetry being oriented perpendicular to the longitudinal axis 16 of the fastener 10, as best seen in FIG. 4.

Figure 4:
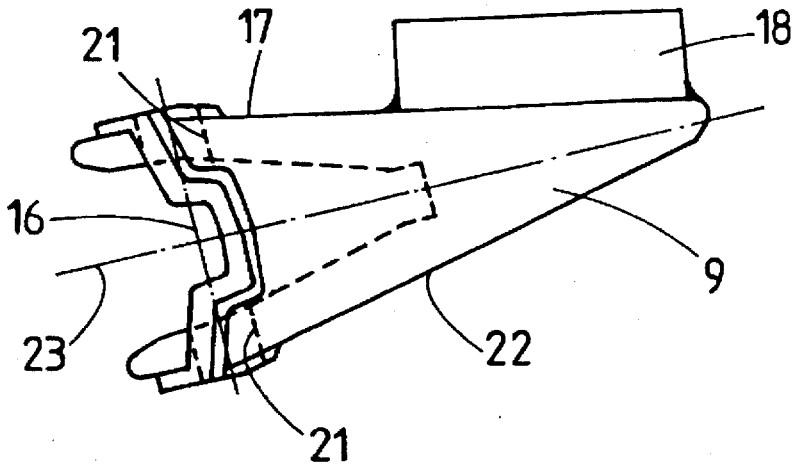
FIG. 4 is a side elevational view, on an enlarged scale, of a protective cap for placement of an engagement member.

As shown in particular in FIGS. 3 and 4, the fastener 10, i.e. the heavy-type dowel pin 11, is received in a bore 20 of the engagement member 8 and two opposing, aligned bores of the protective cap 9. A snug fit between the protective cap 9 and the engagement member 8 is ensured by the truncated pyramid shaped configuration of the engagement member 8.

While the invention has been illustrated and described as embodied in a ballast excavation and conveying chain assembly, it is not intended to be limited to the details shown since various modifications and structural changes may be made without departing in any way from the spirit of the present invention.

What is claimed as new and desired to be protected by Letters Patent is set forth in the appended claims:

1. An excavating and conveying chain assembly for transporting ballast of a track, comprising a plurality of chain links hingedly connected to each other for traveling along a transport path, each of said chain links including a shovel-type scraper blade having a link-distal end formed with a plurality of projecting scraper fingers, each scraper finger being of two-part configuration, with a first part being formed by an engagement member secured to the scraper blade and jutting out in a finger-like manner, and with a second part being formed by a protective cap that is pushed onto the engagement member and detachably secured thereto by a fastener, wherein each chain link is provided with a shovel-type blade element projecting in finger-like manner between neighboring scraper fingers beyond the link-distant end of the scraper blade.

2. The excavating and conveying chain defined in claim 1 wherein the engagement member is fully enveloped by the protective cap.

3. The excavating and conveying chain defined in claim 1 wherein a transition area is formed between the engagement member and the link-distal end of the scraper blade, said fastener being positioned in the transition area.

4. The excavating and conveying chain defined in claim 1 wherein the engagement member is formed with a bore, and the protective cap is formed with two opposing, aligned bores, said fastener being a dowel pin which traverses the bore of the engagement member and the two aligned bores of the protective cap and extends at an angle to a working surface defined by the scraper blade for support of ballast gravel.

5. The excavating and conveying chain defined in claim 1 wherein the fastener defines a longitudinal axis, said protective cap exhibiting a working surface and a surface in opposition thereto which form together a trapezoidal cross section and extend at an angle to a plane of symmetry of the engagement member, with the plane of symmetry extending perpendicularly to the longitudinal axis of the fastener.

6. The excavating and conveying chain defined in claim 1 wherein the scraper blade exhibits a working surface, said fastener being defined by a longitudinal axis that extends at an angle to the working surface.

7. The excavating and conveying chain defined in claim 1 wherein the scraper fingers are positioned in superimposed relationship, with the protective cap of a lowermost scraper finger in immediate proximity of the transport path exhibiting a working surface, and further comprising a wearing plate for attachment to the working surface of the lowermost scraper finger.

8. The excavating and conveying chain defined in claim 1 wherein the engagement member is of truncated cone shaped configuration.

9. The excavating and conveying chain defined in claim 1 wherein the protective caps of the scraper fingers define working surfaces extending in a common plane.

10. An earthworking scraper for loosening and transporting ballast of a track bed along a transport path, comprising:

a plurality of chain links hingedly connected to each other to form an endless chain track;

a scraper blade secured to every other one of the chain links; and a plurality of scraper fingers projecting from the scraper blade, each of the scraper fingers including an engagement member secured to and projecting from the scraper blade, a protective cap that is pushed onto the engagement member, and a fastener for detachably securing the protective cap to the engagement member, wherein each chain link is provided with a shovel-type blade element projecting in finger-like manner between neighboring scraper fingers beyond the scraper blade.

11. The scraper defined in claim 10 wherein the engagement member is fully enveloped by the protective cap.

12. The scraper defined in claim 10 wherein a transition area is formed between the engagement member and the scraper blade, said fastener being positioned in the transition area.

13. The scraper defined in claim 10 wherein the engagement member is formed with a bore, and the protective cap is formed with two opposing, aligned bores, said fastener being a dowel pin which traverses the bore of the engagement member and the two aligned bores of the protective cap and extends at an angle to a working surface defined by the scraper blade for support of ballast gravel.

14. The scraper defined in claim 10 wherein the fastener defines a longitudinal axis, said protective cap exhibiting a working surface and a surface in opposition thereto which form together a trapezoidal cross section and extend at an angle to a plane of symmetry of the engagement member, with the plane of symmetry extending perpendicularly to the longitudinal axis of the fastener.

15. The scraper defined in claim 10 wherein the scraper blade exhibits a work surface, san fastener being defined by a longitudinal axis that extends at an angle to the work surface.

16. The scraper defined in claim 10 wherein the scraper fingers are positioned in superimposed relationship, with the protective cap of a lowermost scraper finger in immediate proximity of the transport path exhibiting a working surface, and further comprising a wearing plate for attachment to the working surface of the lowermost scraper finger.

17. The scraper defined in claim 10 wherein the engagement member is of truncated cone shaped configuration.

18. The scraper defined in claim 10 wherein the protective caps of the scraper fingers define working surfaces extending in a common plane.

* * * * *